US008991974B2

(12) United States Patent
Baker et al.

(10) Patent No.: US 8,991,974 B2
(45) Date of Patent: Mar. 31, 2015

(54) INK JETTING

(75) Inventors: Richard J. Baker, West Lebanon, NH (US); Bailey Smith, Bow, NH (US); Roger Therrien, Hanover, MA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 635 days.

(21) Appl. No.: 12/483,852

(22) Filed: Jun. 12, 2009

(65) Prior Publication Data

US 2009/0322826 A1 Dec. 31, 2009

Related U.S. Application Data

(60) Provisional application No. 61/076,788, filed on Jun. 30, 2008.

(51) Int. Cl.

| | |
|---|---|
| ***B41J 2/145*** | (2006.01) |
| ***B41J 2/15*** | (2006.01) |
| ***B41J 2/155*** | (2006.01) |
| ***B41J 25/00*** | (2006.01) |
| ***B41J 2/505*** | (2006.01) |

(52) U.S. Cl.

CPC .. *B41J 2/15* (2013.01); *B41J 2/155* (2013.01); *B41J 25/001* (2013.01); *B41J 2/5056* (2013.01); *B41J 2202/20* (2013.01)

USPC ..... 347/40

(58) Field of Classification Search

USPC ..... 347/40

See application file for complete search history.

(56) References Cited

U.S. PATENT DOCUMENTS

| | | | | |
|---|---|---|---|---|
| 4,972,270 | A | 11/1990 | Kurtin et al. | |
| 5,208,605 | A | 5/1993 | Drake | |
| 5,265,315 | A | 11/1993 | Hoisington et al. | |
| 5,771,052 | A | 6/1998 | Hine et al. | |
| 5,949,453 | A * | 9/1999 | Harris et al. | 347/43 |
| 6,533,385 | B1 | 3/2003 | Mackay et al. | |
| 6,554,398 | B2 * | 4/2003 | Wyngaert et al. | 347/42 |
| 6,575,558 | B1 | 6/2003 | Grose et al. | |
| 6,592,204 | B1 | 7/2003 | Beliveau et al. | |
| 6,663,222 | B2 * | 12/2003 | Verhoest et al. | 347/40 |
| 6,755,511 | B1 | 6/2004 | Moynihan et al. | |
| 6,860,585 | B2 * | 3/2005 | Serra et al. | 347/40 |
| 7,381,444 | B2 * | 6/2008 | Shigemura et al. | 427/162 |

(Continued)

FOREIGN PATENT DOCUMENTS

| | | |
|---|---|---|
| CN | 1113184 | 12/1995 |
| EP | 0654352 | 10/1994 |

(Continued)

OTHER PUBLICATIONS

International Search Report and Written Opinion for App. Ser. No. PCT/US2009/047225, dated Nov. 27, 2009, 11 pages.

(Continued)

*Primary Examiner* — Stephen Meier
*Assistant Examiner* — Renee I Wilson
(74) *Attorney, Agent, or Firm* — Fish & Richardson P.C.

(57) ABSTRACT

Among other things, for jetting ink, a first set of orifices of an apparatus are arranged to print at a first maximum resolution along a direction different from a process direction. A second set of orifices is coupled to the first set of orifices. The second set of orifices is arranged to print at a second maximum resolution lower than the first maximum resolution along a direction different from the process direction.

22 Claims, 5 Drawing Sheets

(56) References Cited

U.S. PATENT DOCUMENTS

| | | | | |
|---|---|---|---|---|
| 2002/0080210 | A1 | 6/2002 | Verhoest et al. | |
| 2002/0085067 | A1 | 7/2002 | Palifka et al. | |
| 2006/0092204 | A1* | 5/2006 | White et al. | 347/12 |
| 2006/0092219 | A1* | 5/2006 | Kurita et al. | 347/40 |
| 2007/0296757 | A1 | 12/2007 | Mills et al. | |
| 2009/0290000 | A1 | 11/2009 | McDonald | |

FOREIGN PATENT DOCUMENTS

| | | |
|---|---|---|
| JP | 05-096728 | 4/1993 |
| JP | 5096728 | 4/1993 |
| JP | 2006-035492 | 2/2006 |
| JP | 2006035492 | 2/2006 |

OTHER PUBLICATIONS

Japanese Office Action, with English Translation, JP Application No. 2011-516431, mailed Aug. 21, 2013, 13 pages.

Zhou, Examiner in corresponding Chinese application serial No. 200980132783.6 dated Dec. 28, 2012 (with English translation), 15 pages.

Supplemental European Search Report, EP09774021, mailed Apr. 2, 2014, 3 pages.

* cited by examiner

INK JETTING

This application claims the benefit of U.S. Provisional Application No. 61/076,788, filed Jun. 30, 2008, and incorporated herein by reference.

TECHNICAL FIELD

This description relates to ink jetting.

BACKGROUND

Ink jetting can be done using an ink jet printhead that includes jetting assemblies. Ink is introduced into the ink jet printhead and when activated, the jetting assemblies jet ink to form images on a substrate.

SUMMARY

In an aspect, for jetting ink, a first set of orifices of an apparatus are arranged to print at a first maximum resolution, the first maximum resolution being along a direction different from a process direction. A second set of orifices is coupled to the first set of orifices. The second set of orifices is arranged to print at a second maximum resolution lower than the first maximum resolution, the second maximum resolution being along a direction different from the process direction.

Implementations may include one or more of the following features. The first set of orifices belongs to a first printhead and the second set of orifices belongs to a second printhead. The position of the first printhead relative to the second printhead is adjustable. The orientation of the first printhead relative to the process direction is adjustable. The first printhead is in front of the second printhead in the process direction. The first printhead is behind the second printhead in the process direction. The first printhead is in front of the second printhead in a direction perpendicular to the process direction. The first printhead is behind the second printhead in a direction perpendicular to the process direction. The first and second printheads each comprises a jetting assembly having more than 100 jets. The angle between the process direction and a length of the jetting assembly in the first printhead is between about 30° to about 85°. The second printhead is arranged to print at between about 100 dpi and 400 dpi. The first printhead is arranged to print at greater than 800 dpi. The first printhead is arranged to print at greater than 1000 dpi. The first printhead is arranged to print at about 1200 dpi. The different direction is perpendicular to the process direction. More than one printhead is arranged to print at a higher maximum resolution than the second printhead. The first and second printheads are incorporated in a single-pass ink jet printer and the substrate transports along the process direction. The first and second printheads are incorporated in a step-and-repeat ink jet printer and the substrate transports along a direction perpendicular to the process direction. The first printhead is arranged to print a portion of an image along a direction perpendicular to the process direction. During the relative motion, the substrate is moving along the process direction and the apparatus is stationary. During the relative motion, the substrate is stationary and the apparatus is moving along the process direction. The first set of orifices is in a first set of parallel arrays and the second set of orifices is in a second set of parallel arrays having an angle ranging from about 30° to about 85° with respect to the first set of parallel arrays.

In an aspect, during a relative motion in a process direction between an ink jetting apparatus and a substrate, a first portion of the ink jetting apparatus is caused to print on the substrate at a first maximum resolution. A second portion of the ink jetting apparatus is caused to print on the substrate at a second maximum resolution lower than the first resolution in a direction different from the process direction.

Implementations may include one or more of the following features. The location of the first portion of the ink jetting apparatus is adjusted relative to the second portion of the ink jetting apparatus prior to the relative motion. The causing comprises causing the first portion of the ink jetting apparatus to print in an area of the substrate before the second portion of the ink jetting apparatus prints in the area. The causing comprises causing the first portion of the ink jetting apparatus to print in an area of the substrate after the second portion of the ink jetting apparatus prints in the area. The causing comprises moving the ink jetting apparatus in the process direction perpendicular to a direction the substrate transports and printing on the substrate. The causing comprises transporting the substrate in a direction parallel to the process direction and printing on the substrate.

These and other aspects and features can be expressed as methods, apparatus, systems, means for performing a function, and in other ways.

Other features and advantages will be apparent from the following detailed description, and from the claims.

DESCRIPTION

Figure 1B:
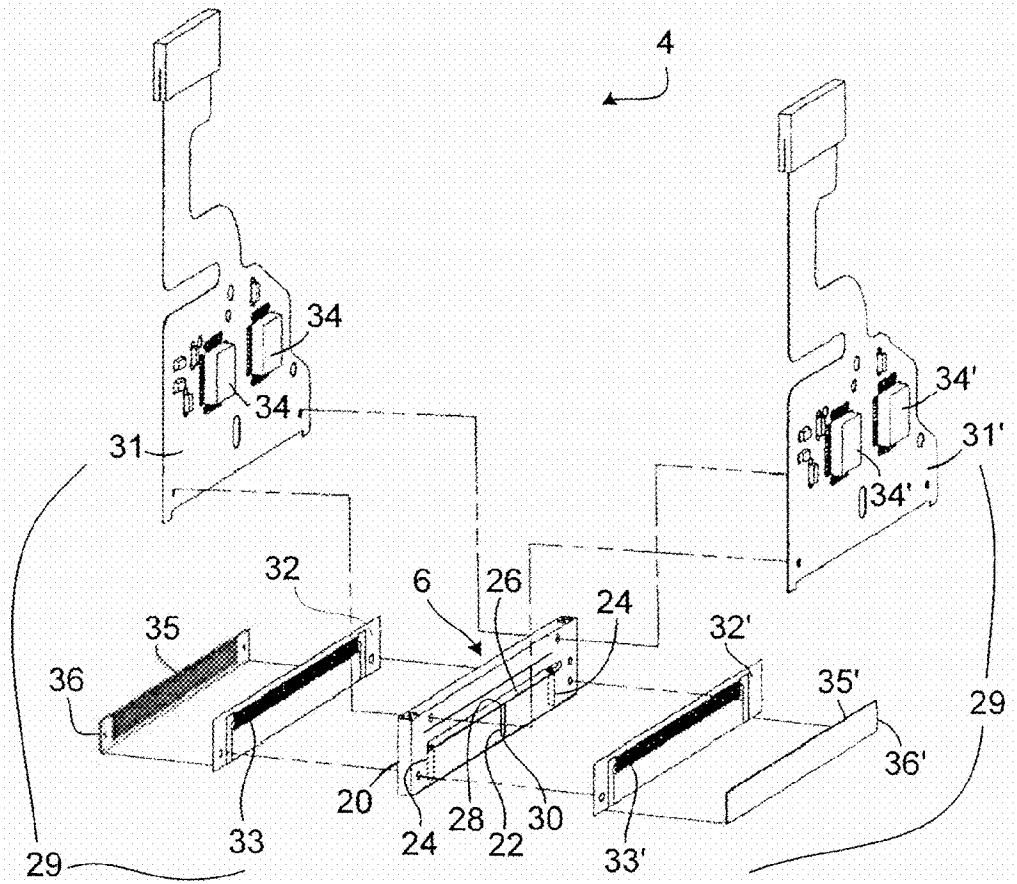
FIGS. 1A and 1B are exploded perspective views of an ink jet printhead and an ink jetting assembly.
Figure 1A:
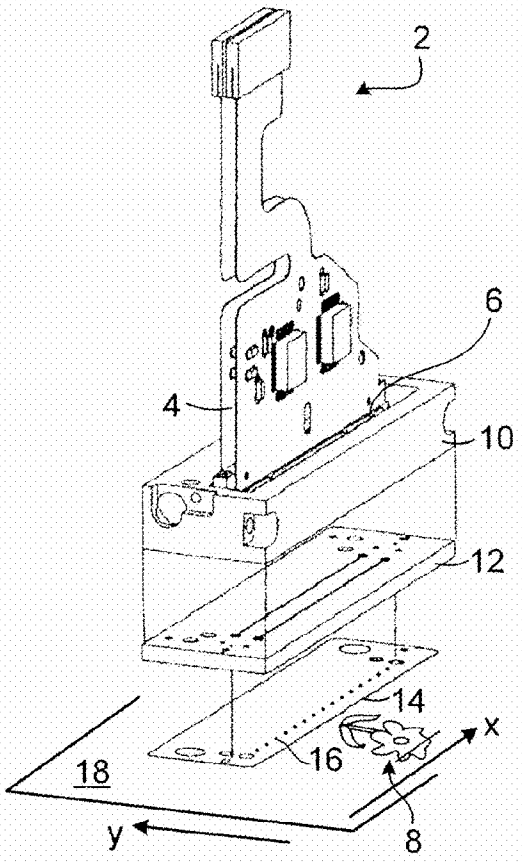

Referring to FIG. 1A, ink jetting can be done using an ink jet printhead 2 that includes at least one jetting assembly 4 assembled into a collar element 10. The collar element 10 is attached to a manifold plate 12 which is attached to a plate 14 having orifices 16. When in use, the printhead 2 and a substrate 18 move relative to each other along a process direction perpendicular to a length 6 of the jetting assembly 4 (see also FIG. 1B) and during the relative motion, ink is loaded into the jetting assembly 4 through the collar element 10 and jetted through orifices 16 to form an image 8 on a substrate 18. In particular, when the ink jet printhead 2 is assembled into what is called a single-pass ink jet printer, the printhead 2 jets ink drops on the substrate 18 that is moving in a transporting direction y. When the ink jet printhead 2 is assembled into what is called a step-and-repeat ink jet printer, the printhead 2 moves along they direction and jets ink drops on the substrate 18 that moves in a transporting direction x.

Referring to FIG. 1B, the ink jetting assembly 4 has a body 20 that includes one or more ink passages 24 and an ink fill passage 26. A cavity plate and a stiffener plate (not shown) are attached on the opposite surfaces of the body 20 to form an array of wells 22 (not all shown) on each surface. Each well 22 can be elongated and the body 20 can include ceramic, sintered carbon, or silicon. Each ink passage 24 receives ink from an ink reservoir (not shown) and delivers ink to the ink fill passage 26. When the opposite surfaces are covered by polymer films 32 and 32', pumping chambers, for example, elongated pumping chambers, are formed by the wells 22. Each pumping chamber includes an ink inlet 28 to receive ink from the ink fill passage 26 and an ink outlet end 30 to direct ink back into the body 20 through an ink jetting passage (not shown), from where ink is jetted at one of a row of openings (not shown) at the bottom of the body 20. In some embodiments, the orifice plate 14 (FIG. 1A) is attached directly to the bottom of the body 20. Each orifice 16 on the orifice plate 14 corresponds to one opening and ink is jetted through the orifices 16 onto the substrate 18 (FIG. 1A). In some embodiments, when two or more jetting assemblies 4 are assembled in the printhead 2 as shown in FIG. 1A, the manifold plate 12 is arranged between bottoms of the bodies 20 and the orifice plate 12 and manifolds multiple rows of openings, each at the bottom of one body 20, into a single row of openings from which ink passes.

Generally, each pumping chamber, together with its corresponding ink jetting passage, the opening and the orifice can be referred to as a jet of the jetting assembly. Information about the jetting assembly 4 is also provided in U.S. Ser. No. 12/125,648, filed May 22, 2008, which is incorporated here by reference.

The jetting assembly 4 also includes electronic components 29 to trigger the pumping chambers formed from the wells 22 to jet ink. For example, the electronic components 29 include two sets of electrodes 33 and 33' on the polymer films 32 and 32', which are connected by leads (not shown) to respective flexible printed circuits 31, 31' and integrated circuits 34 and 34'. Piezoelectric elements 36 and 36' are attached to the outer side of each of the polymer films 32 and 32', respectively, and each includes a set of electrodes 35 and 35' that contacts the polymer films 32 and 32'. Each electrode in the electrode sets 35 and 35' covers a pumping chamber. In use, electrode sets 35 and 35' receives pulse voltages sent from the integrated circuits 34 and 34' and activates the corresponding portion of the piezoelectric elements 36 and 36' to change their shapes to apply pressures to corresponding pumping chambers. Information about the ink jetting assembly is also provided in U.S. Pat. No. 6,755,511, and incorporated here by reference.

Production of a high resolution image (expressed as a number of dots or pixels per inch (dpi) of substrate), for example, along a direction different from, e.g., perpendicular to the process direction, requires a relatively smaller pitch between adjacent pumping chambers or wells 22 (FIG. 1B). The size of the pitch may reach a mechanical limit that limits the density of the pumping chambers or wells 22 in a jetting assembly. In some embodiments, more than one jetting assembly covering a given width of the substrate is used to achieve a higher resolution.

Figure 1C:
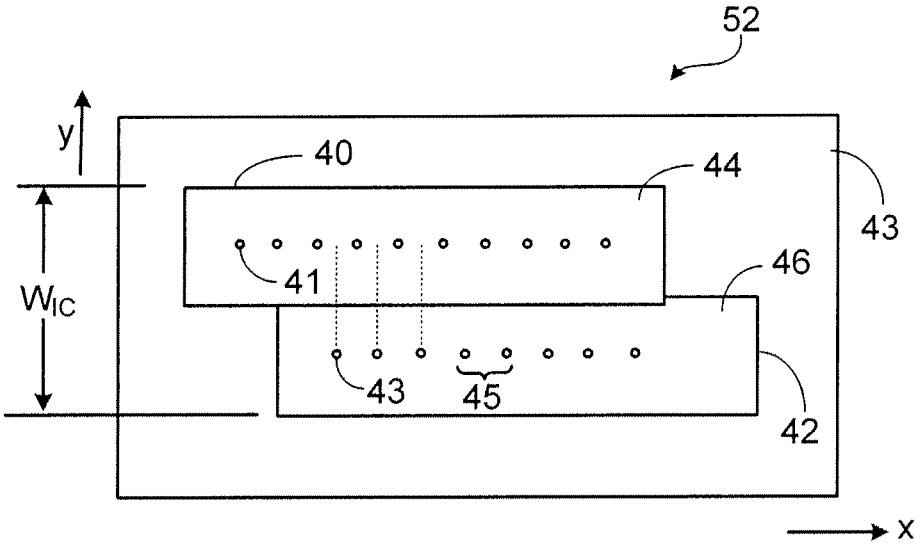
FIG. 1C is a schematic bottom view of an ink jet printhead.

Referring to FIG. 1C, an ink jet printhead 52 includes jetting assemblies 40 and 42, each as described in FIG. 1B, assembled adjacent to each other into a collar element 38 (orifice plate and manifold plate not shown). The ink jet printhead 52 also includes opening arrays 41 and 43 at the bottom of the body 44 and 46 of the jetting assemblies 40 and 42, respectively. The pitch distance in each jetting assemblies can be, for example, the same. The two jetting assemblies are so arranged that each opening in the array 41 and a corresponding opening in the array 43 offsets by, for example, half the distance 45 between the neighboring opening distances along the direction perpendicular to the process direction y. A manifold plate (not shown) can be attached to the bottom of the bodies 44 and 46 and manifolds the two arrays of openings into one array, which matches the array of orifices in an orifice plate. The density of the orifices along the length of the jetting assemblies 40 and 42 is effectively doubled along the combined length of the two jetting assemblies and a higher resolution image can be printed.

The combined width $W_{1C}$ of the jetting assemblies 40 and 42 in the process direction y is increased relative to a width of a single jetting assembly. Printing at a high resolution along the process direction y requires a high precision relative motion between the substrate and the printhead along the process direction y. Printing at a high precision along a direction different from, for example, perpendicular to, the process direction y, requires careful control of the side to side motion of the substrate along the x direction when the substrate is moving along the process direction y. Even higher resolution printheads can be made using more than two jetting assemblies each offset relative to the others in a similar way described above, the use of which calls for increasingly high precision control of the substrate motion. Information about ink jet printhead 52 having more than one jetting assembly is also provided in U.S. Pat. No. 6,592,204, U.S. Pat. No. 6,575,558, and U.S. Pat. No. 5,771,052, all of which being incorporated here by reference.

Figure 2:
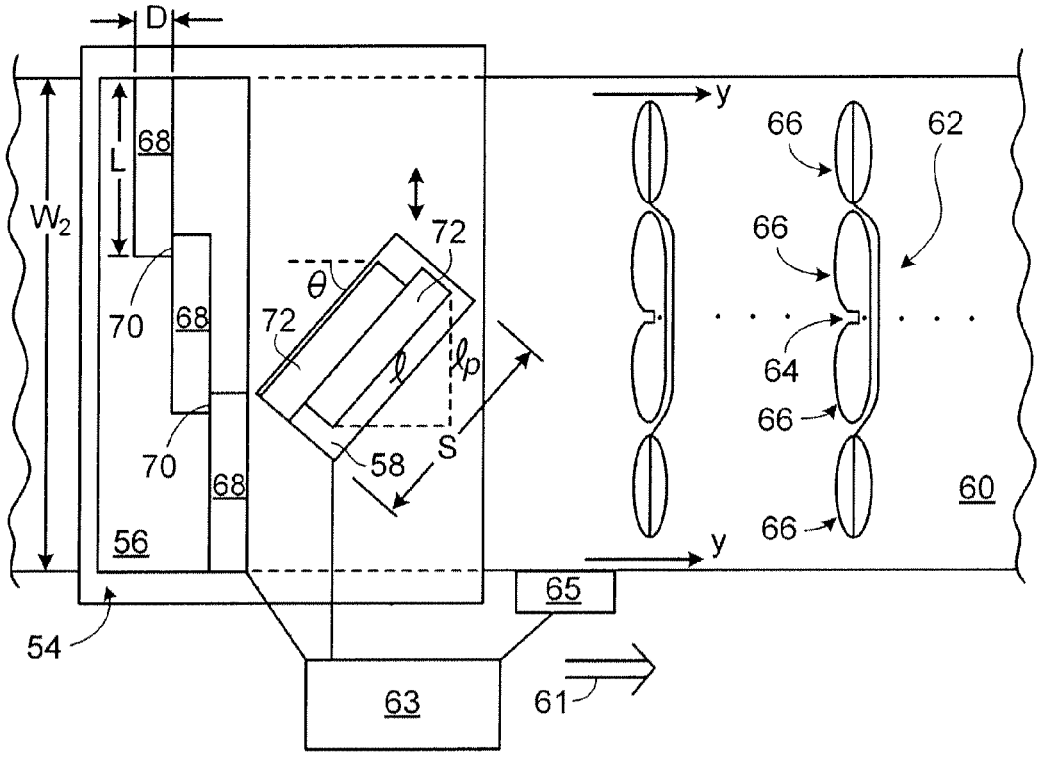
FIGS. 2 and 3 are schematic top views of ink jet printers.

Referring to FIG. 2, during relative motion 61 between an ink jet printer 54 and a substrate 60 along the y direction (the process direction and the substrate transporting direction), the single-pass ink jet printer 54 is stationary and the substrate 60 moves along they direction. The ink jet printer 54 includes a high resolution printhead module 58 that prints a high resolution feature, for example, feature 64 of an image 62, across the substrate 60 and a low resolution printhead module 56 to print low resolution features, for example, features 66 of the image 62 across the substrate 60. The ink jet printer 54 also includes a controller 63 connected to the printhead modules 56 and 58 and a detector 65 in communication with the substrate 60. Based on the information for the image 62 obtained before printing and the instant information about the substrate motion sent from the detector 65 during printing, the controller 63 sends signals to the electronic components 29 (FIG. 1B) of each jetting assembly in each printhead of printhead modules 56 and 58 to activate the jets to jet ink at proper location of the substrate 60. Repeated copies of the image 62 can be produced along the process direction y as the substrate 60 moves.

The printhead module 56 in this example includes one or more printheads 68 each having the features of the printhead 2 of FIG. 1A and having aligned its length parallel to the width $W_2$ of the substrate 60 to cover the total width of an image desired to be printed the substrate 60. In the example shown in the figure, each printhead 68 contains at least one array of orifices and is capable of printing at the same maximum resolution. The printheads 68 are staggered across the substrate 60, each partially overlapping with its neighboring printhead in regions 70, in which each orifice of the printhead 68 aligns with a corresponding orifice of its overlapping printhead along the y direction. The at least one array of the orifices in one of the printheads 68 is parallel to the arrays of orifices in other printheads 68.

Each printhead 68 has a length L of about 2 to 4 inches and a width D of about 1 inch, and the total width $W_2$ the printhead 56 can print can range from about 2 cm to more than 2 meters. The printhead module 56 can print at a maximum resolution, along the process direction y, for example, of at least about 100, 200, 300, or 360 dpi, and/or up to about 400, 600, 720, 1000, or 1200 dpi, depending on the resolution at which each printhead 68 included in the module 56 can print. In some embodiments, when the low resolution features 66 require a resolution higher than 400 dpi, each printhead 68 can include the features of printhead 52 described in FIG. 1C to print at a higher maximum resolution.

The printhead module 58 includes one or more printhead 72 each having the features of printhead 2 of FIG. 1A or of printhead 52 of FIG. 1C. The printheads 72 can be arranged relative to each other similarly as the printheads 68 in the printhead module 56 to increase the span S of the printhead module 58.

In some embodiments, the printhead module 58 is arranged so that the length 1 of each printhead 72 forms an angle θ with the process direction y. When the printhead module 58 includes more than one jetting assembly, the corresponding pumping chambers and orifices of the jetting assemblies in the overlapping regions are aligned along the process direction y. The maximum resolution in the direction perpendicular to process direction, at which the printhead 58 is capable of printing, is 1/sin θ times the maximum resolution at which each printhead 72 is capable to print when its length 1 is perpendicular to the process direction y. The angle θ, and thus the orientation of the printhead module relative to the process direction, can be adjustable for different resolution requirements. For example, the angle θ is about 30 degrees to about 85 degrees, e.g., about 60 degrees to about 80 degrees, about 70.53 degrees, or about 75.5 degrees and the printhead module 58 is capable of printing at a maximum resolution, for example, of at least about 400 dpi, 600 dpi, or 800 dpi, and/or up to, for example, 1000 dpi, 1200 dpi, 1600 dpi, 2000 dpi, 4000 dpi, or 6000 dpi.

Generally, the span S of the printhead module 58, and therefore the total number of printheads 72, is selected so that the projected width $I_p$ along the direction perpendicular to the process direction y covers the width of the high resolution feature 64 and can be smaller than the total width $W_2$ of the substrate 50.

In the process direction y, the printhead module 58 can be either ahead of (FIG. 2) or behind (not shown) the printhead module 56 relative to the process direction y, depending on, for example, properties, such as visual effect and quality requirement of the image 62, properties of ink used to print the different features of the image 62, and properties of the substrate 60. In the direction perpendicular to the process direction y, the printhead module 58 can be adjusted to a location that matches the location of the high resolution feature 64.

In some embodiments, the image 62 includes more than one high resolution feature 64 in the direction perpendicular to the process direction y. In such embodiments, additional one or more printhead modules 58 can be installed at other locations across the substrate in the ink jet printer 54, each arranged to print one or more high resolution features 64. In some embodiments, one printhead module 58 is capable of printing at a different high resolution from other printhead modules 58.

Figure 3:
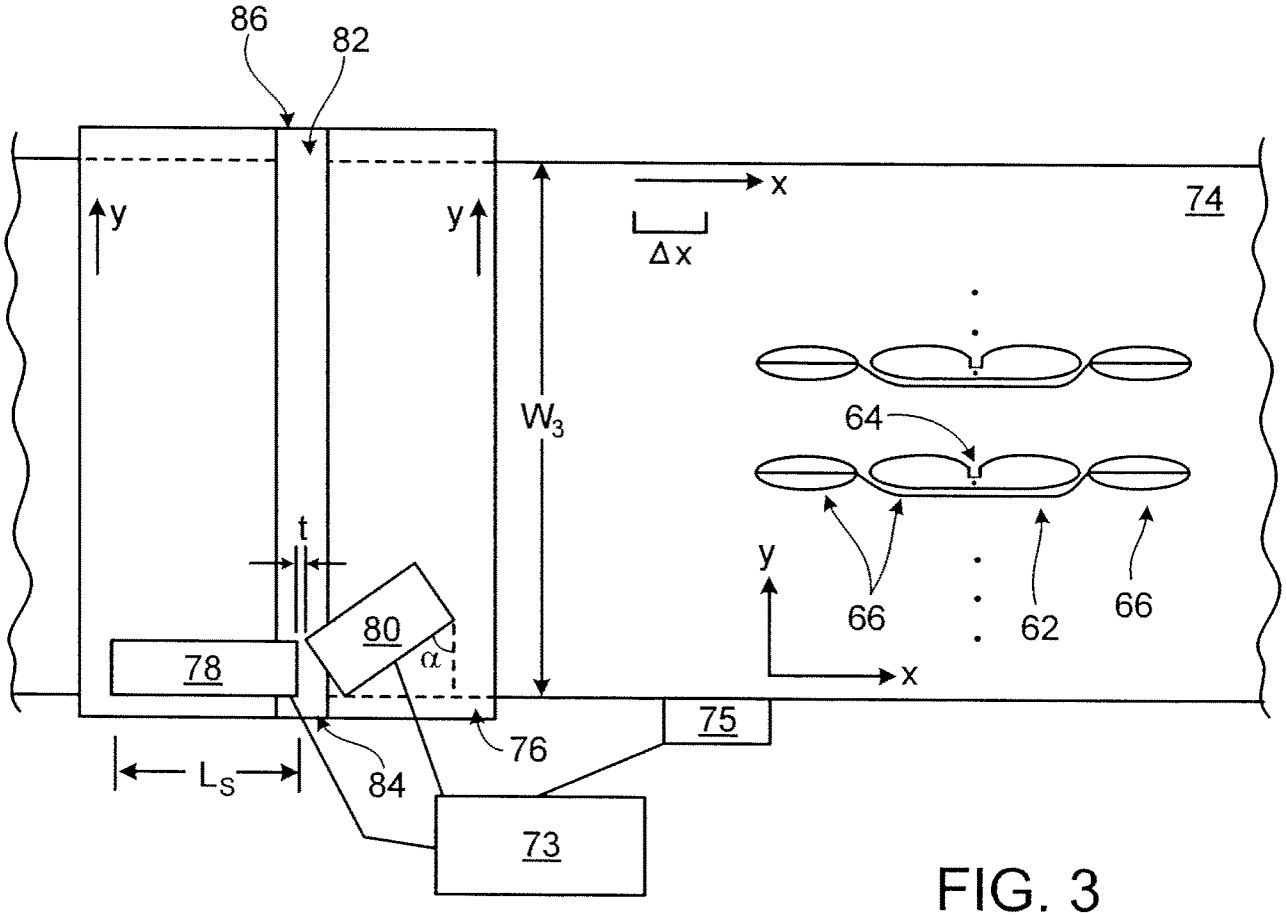

Referring to FIG. 3, in contrast to FIG. 2 where the image 62 is printed on the substrate 60 during the motion of the substrate 60, a step-and repeat ink jet printer 76 that includes printhead modules 78 and 80 mounted on a rail 82 prints the image 62 on a substrate 74 when the substrate 74 is stationary and the print modules 78 and 80 scans across the substrate 74. In particular, during printing, the substrate 74 moves along the transporting direction x for a step width of Δx and stops, the printhead modules 78 and 80 then move along the rail 82 back and forth between two ends 84 and 86 in a direction parallel to y and print part of or all of the image 62 on the substrate 74. The substrate and the printhead modules then repeat the motions to complete printing image 62. Each movement of the printhead modules 78 and 80 from one of the two ends 84 and 86 to the other end of the two ends 84 and 86 in either the +y direction or the −y direction, is called a pass. The ink jet printer 76 also includes a controller 73 and a detector 75 that work similarly to the controller 63 and the detector 65 of FIG. 2.

In some embodiments, the printhead modules 78 and 80 print only during one of each two sequential passes and the substrate 74 moves Δx once every two passes. In some embodiments, the printhead modules 78 and 80 print bi-directionally in multiple 25 passes, i.e., the printhead modules print during each pass and the substrate 74 moves along the transporting direction x after each pass. Δx can be about one pixel to about a length $L_s$ of the printhead module 78 when the image can be printed, for example, in one pass.

The printhead modules 78 and 80 have similar features, for example, resolutions, to the printhead modules 56 and 58, respectively. In particular, the printhead module 80 forms an angle α that is similar to the angle θ described above with respect to the y direction. However, unlike the single-pass ink jet printer 54, a total width $L_s$ that the printhead module 78 prints during one pass can be smaller than the width $W_3$ of the substrate, and therefore, fewer printheads are needed for the printhead module 78. Generally, the total width $L_s$ is at least one, for example, two, three, four, or more times Δx. In some embodiments, printhead module 78 includes at least one, for example, many printheads as described in FIG. 1A or FIG. 1C and the total length $L_s$ can range from about 2 cm to more than 2 meters.

Referring to FIGS. 3, 3A, 3B, and 3C, the printhead module 80 can have various positions relative to the printhead module 78. In the examples shown in the FIGS. 3 and 3A, the printhead module 80 is in front of and behind the printhead module 78 in the transporting direction x, respectively. In the examples shown in the FIGS. 3B and 3C, the printhead module 80 is in front of and behind the printhead module 78 in the y direction, respectively. The selection of the arrangement between the printhead modules 78 and 80 depends, for example, on the factors discussed with respect to the printhead modules 56 and 58. The arrangement shown in FIGS. 3 and 3A can allow the features printed by the first printhead in the transporting direction x to dry before the second printhead prints the other features (dry printing), and the arrangement shown in FIGS. 3B and 3C can allow the features later printed to be formed when the features earlier printed are still wet (wet printing).

Figure 3A:
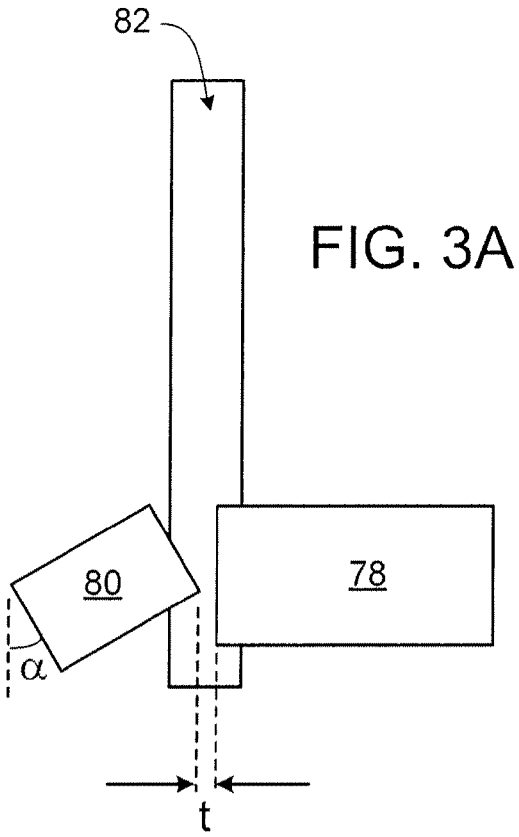
FIGS. 3A-3C are schematic top views of a portion of a step-and-repeat ink jet printer.
Figure 3B:
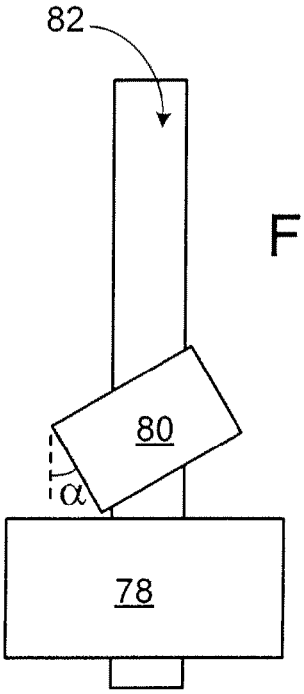
Figure 3C:
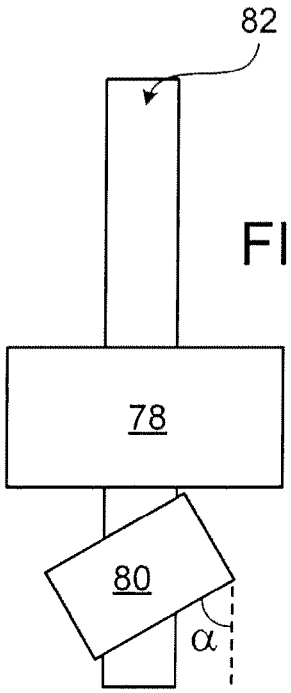

In the examples shown in FIGS. 3 and 3A, the distance t between the printhead modules 78 and 80 along the process direction x is also adjustable. To print the high resolution features, for example, the feature 64 of the image 62, at a precise location relative to the rest of the image, the distance t is carefully adjusted before printing based on the dimensions of the image 62, the total width $L_s$ of the printhead module 78, and the step width Δx of the substrate motion.

The inclusion of two or more printhead modules arranged to print at different resolutions in the single-pass ink jet printer 54 or the step-and-repeat ink jet printer 76 separates the process of printing of high resolution features, for example, 800 dpi to 1200 dpi, from the process of printing of relatively low resolution features, for example, 100 dpi to 400 dpi, of an image. This separation allows the printhead module that prints at a relatively low resolution to include fewer printheads. Fewer printheads are required to be arranged as described in FIG. 1C, which in turn allows the relative motion in the process direction between the substrate and the printhead modules to have a relatively lower precision than, for example, a printhead module that includes printheads arranged as shown in FIG. 1C to realize high resolution printing. For images that contains a substantial amount of low resolution features, using a low-resolution printhead module to print these features can reduce the cost of printing, for example, the cost of the printer, and be done at a higher printing speed.

Other embodiments are also within the scope of the following claims.

For example, printheads other than that described in FIG. 1A can be used, for example, printheads that are made of silicon and described in U.S. Pat. No. 5,265,315 and printheads described in U.S. Ser. No. 12/125,648, filed May 22, 2008, both of which are incorporated here by reference. The printhead modules in each ink jet printer can have different relative locations than the ones exemplified in FIGS. 2, 3, and 3A-3C.

For example, the jetting assembly 4 can include the body 20 having wells machined on surfaces of the body 20. Pumping chambers can be formed without the use of the cavity plate and by sealing the machined wells in the body 20 using polymer films. The pumping chambers can be activated by piezoelectric elements attached to an outer surface of the polymer films that is opposite to an inner surface that contacts the body 20. In some implementations, the piezoelectric elements can directly seal the wells to form pumping chambers without the polymer films between the wells and the piezoelectric elements. Activation of the pumping chambers can be done using elements, e.g., electrodes and integrate circuits, similar to those discussed with regard to FIGS. 1A-1B. Features of the ink droplets and images, for example, sizes of the ink droplets and resolution of the images, printed by such jetting assemblies are similar to those printed by the jetting assemblies of FIGS. 1A-1B.

Information about jetting assemblies and ink jetting devices is also provided, for example, in U.S. Pat. No. 6,755,511 and U.S. Ser. No. 09/749,893, filed Dec. 29, 2000, and incorporated here by reference.

What is claimed is:

1. An apparatus for use in jetting ink on a substrate during relative motion of the apparatus and the substrate along a process direction, the apparatus comprising:

a first printhead module comprising orifices arranged to print at a first resolution along a direction which is different from the process direction;

a second printhead module comprising orifices arranged to print at a second resolution along the direction which is different from the process direction, wherein the second resolution is lower than the first resolution, and wherein the first printhead module and the second printhead module are arranged on a single mount such that an angle between the first printhead module and the second printhead module is adjustable and the angle between the first printhead module and second printhead module is adjustable between about 30° to about 85°.

2. The apparatus of claim 1 in which the first printhead module comprises one or more printheads, and the second printhead module comprises one or more printheads.

3. The apparatus of claim 1 in which the orientation of the orifices of the first printhead module relative to the process direction is adjustable.

4. The apparatus of claim 1 in which the first printhead module is in front of the second printhead module in the process direction.

5. The apparatus of claim 1 in which the first printhead module is behind the second printhead module in the process direction.

6. The apparatus of claim 1 in which the first printhead module is in front of the second printhead module in a direction perpendicular to the process direction.

7. The apparatus of claim 1 in which the first printhead module is behind the second printhead module in a direction perpendicular to the process direction.

8. The apparatus of claim 2 in which the one or more of the first printhead module and the second printhead module each comprises a jetting assembly having more than 100 jets.

9. The apparatus of claim 8 in which an angle between the process direction and the direction which is different from the process direction is between about 30° to about 85°.

10. The apparatus of claim 1 in which the second printhead module is arranged to print at between about 100 dpi and 400 dpi.

11. The apparatus of claim 1 in which the first printhead module is arranged to print at greater than 800 dpi.

12. The apparatus of claim 1 in which the first printhead module is arranged to print at greater than 1000 dpi.

13. The apparatus of claim 1 in which the first printhead module is arranged to print at about 1200 dpi.

14. The apparatus of claim 1 in which the direction which is different from the process direction is perpendicular to the process direction.

15. The apparatus of claim 1 in which the first and second printhead modules are incorporated in a single-pass ink jet printer and the substrate transports along the process direction.

16. The apparatus of claim 1 in which the first and second printhead modules are incorporated in a step-and-repeat ink jet printer and the substrate transports along a direction perpendicular to the process direction.

17. The apparatus of claim 1 in which one or more arrays of orifices in the first printhead module and one or more arrays of orifices in the second printhead module form an angle ranging from about 30° to about 85°.

18. The apparatus of claim 1, wherein:

neighboring orifices in the first printhead module are separated from each other by a first spacing;

neighboring orifices in the second printhead module are separated from each other by a second spacing; and the first spacing is the same as the second spacing.

19. The apparatus of claim 1, wherein:

the first printhead module comprises first and second printheads;

the first printhead comprises a first array of orifices arranged in a first line;

the second printhead comprises a second array of orifices arranged in a second line;

orifices of the first array are offset from orifices of the second array along a direction parallel to the first line.

20. A method, comprising:

using the apparatus of claim 1 to print an image on a substrate.

21. The method of claim 20, wherein, during the method, the angle between the first printhead module and the second printhead module is changed.

22. The apparatus of claim 1 in which the mount comprises a rail.

* * * * *